US010627153B2

(12) United States Patent
Pompen et al.

(10) Patent No.: US 10,627,153 B2
(45) Date of Patent: Apr. 21, 2020

(54) COOLED CARRIER

(71) Applicant: Asda Stores Limited, Leeds (GB)

(72) Inventors: Peter Pompen, Leeds (GB); Henk Niemansverdriet, Leeds (GB)

(73) Assignee: ASDA STORES LIMITED, Leeds (GB)

( * ) Notice: Subject to any disclaimer, the term of this patent is extended or adjusted under 35 U.S.C. 154(b) by 0 days.

(21) Appl. No.: 15/572,081

(22) PCT Filed: May 6, 2016

(86) PCT No.: PCT/GB2016/051292

§ 371 (c)(1),
(2) Date: Nov. 6, 2017

(87) PCT Pub. No.: WO2016/181111

PCT Pub. Date: Nov. 17, 2016

(65) Prior Publication Data

US 2018/0120021 A1 May 3, 2018

(30) Foreign Application Priority Data

May 8, 2015 (GB) ..... 1507906.4

(51) Int. Cl.
*F25D 3/08* (2006.01)
*F25D 23/06* (2006.01)

(52) U.S. Cl.
CPC ..... *F25D 23/066* (2013.01); *F25D 3/08* (2013.01); *F25D 2303/0832* (2013.01); *F25D 2303/0845* (2013.01)

(58) Field of Classification Search
CPC ..... F25D 3/08; F25D 2303/0832; F25D 2303/0845; F25D 2331/804; A45C 11/20; A47J 41/005
See application file for complete search history.

(56) References Cited

U.S. PATENT DOCUMENTS 1,511,454 A 10/1924 Folger
2,485,647 A * 10/1949 Norquist ..... B65D 81/3823 217/128

(Continued)

FOREIGN PATENT DOCUMENTS

EP 0711964 A1 5/1996
FR 1412618 A * 10/1965 ..... F25D 3/14

(Continued)

OTHER PUBLICATIONS

International Search Report & Written Opinion in International Patent Application No. PCT/GB2016/051292, dated Nov. 17, 2016; 17 pages.

(Continued)

*Primary Examiner* — Frantz F Jules
*Assistant Examiner* — Martha Tadesse
(74) *Attorney, Agent, or Firm* — Schmeiser, Olsen & Watts LLP

(57) ABSTRACT

Carrier for carrying products, the carrier comprising: a plurality of thermally insulated walls (10); a thermally insulated base (20); a liner (30) defining at least part of an interior surface of the carrier; a cooling element (50), wherein the cooling element (50) is arranged to be located behind the liner (30).

12 Claims, 6 Drawing Sheets

(56) References Cited

U.S. PATENT DOCUMENTS

| | | | | |
|---|---|---|---|---|
| 2,850,885 | A * | 9/1958 | Mohr | F25D 3/14 62/372 |
| 4,528,439 | A | 7/1985 | Marney, Jr. et al. | |
| 5,069,358 | A * | 12/1991 | Avery, Jr. | E05G 1/024 109/84 |
| 5,613,274 | A * | 3/1997 | Gerdmann | A47J 45/08 220/753 |
| 6,295,830 | B1 | 10/2001 | Newman | |
| 6,782,711 | B2 * | 8/2004 | Abfalter | F25D 3/08 62/457.7 |
| 7,195,132 | B1 * | 3/2007 | Balam | A47G 23/02 220/560 |
| 2004/0231355 | A1 | 11/2004 | Mayer | |
| 2005/0056048 | A1 * | 3/2005 | Fuchs | A45C 11/20 62/457.7 |
| 2010/0078441 | A1 | 4/2010 | Barnett | |
| 2014/0196496 | A1 * | 7/2014 | Ferguson | F25D 3/06 62/449 |

FOREIGN PATENT DOCUMENTS

| | | | |
|---|---|---|---|
| FR | 1412618 | A | 10/1965 |
| GB | 2475478 | A | 5/2011 |
| WO | 2006095038 | A2 | 9/2006 |

OTHER PUBLICATIONS

Examination Report in UK Patent Application No. GB1507906.4, dated Sep. 22, 2016; 3 pages.
Combined Search and Examination Report in UK Patent Application No. GB1610030.7, dated Sep. 21, 2017; 5 pages.
Combined Search and Examination Report in UK Patent Application No. GB1610029.9, dated Sep. 21, 2016; 6 pages.
Combined Search and Examination Report in U.K. Patent Application No. GB1507906.4, dated Nov. 4, 2015; 7 pages.
Combined Search and Examination Report in U.K. Patent Application No. GB1610030.7, dated Sep. 21, 2016; 3 pages.
Examination Report in U.K. Patent Application No. GB1507906.4, dated Nov. 22 2016; 3 pages.
Examination Report in U.K. Patent Application No. GB1610029.9, dated Sep. 28, 2017; 5 pages.
Examination Report in U.K. Patent Application No. GB1610030.7, dated Sep. 28, 2017; 4 pages.
Examination Report in U.K. Patent Application No. GB1507906.4, dated Sep. 29 2017; 5 pages.
Office Action in Canadian Patent Application No. 2,981,246, dated Dec. 27, 2018; 3 pages.
Office Action in Canadian Patent Application No. 2,981,246, dated Aug. 30, 2019; 5 pages.

* cited by examiner

COOLED CARRIER

FIELD

The present invention is concerned with transporting and/or storing frozen food products. It is particularly, though not exclusively, concerned with the transport of frozen food products from a central warehouse operation to a customer's premises or an intermediate location provided for the purchaser to collect from.

BACKGROUND

It is well known to provide retail services whereby a customer orders food and/or supplies via an internet site for later delivery to his/her home or other location. Most supermarkets in the UK, at least, operate such a service. Many customers enjoy the convenience that this offers and the supermarkets are able to provide additional services to customers which can increase market share and customer satisfaction or loyalty.

Most home delivery services distribute food and produce from a central or regional depot via a fleet of vehicles adapted to carry a plurality of carriers, each carrying a portion of the customer's order. The driver of the vehicle arrives at the customer's address, selects one or more carriers and delivers them to the customer. Often, the carrier is in the form of a crate, arranged to accommodate several disposable carrier bags, which have been pre-filled with the customer's ordered products. The carrier bags are handed to the customer and the crates are returned to the vehicle to be re-used later.

A recent development in delivery of products to customers involves the use of an intermediate facility where products may be delivered and stored before the customer picks them up at a later, convenient, time. This can be useful for customers who cannot guarantee to be at home at a specified time, but who are able to travel via the intermediate facility to retrieve the ordered products.

The intermediate facility is arranged to be highly or completely automated and will robotically deliver the product to a customer collection point upon request. In order to ensure that the customer's food is kept in suitable conditions, portions of the storage arrangement in the facility are chilled to ensure that fresh produce is kept fresh. Other portions of the facility do not require chilling and may be used to store dried and other goods which do not need refrigeration.

A problem arises with frozen goods. It is not generally feasible to provide dedicated storage with active refrigeration to provide storage temperatures suitable for frozen foods. There is therefore a need to provide means to ensure that frozen foodstuffs may be delivered to a facility, stored at the facility and dispensed to the customer whilst ensuring that the frozen foodstuffs remain at or below a predetermined temperature at all times.

It is an example aim of example embodiments of the present invention to at least partially obviate or mitigate the disadvantages of the prior art, whether identified herein or elsewhere, or to at least provide an alternative to existing systems or methods.

SUMMARY

According to an aspect of the present invention, there is provided a carrier for carrying products, the carrier comprising: a plurality of thermally insulated walls; a thermally insulated base; a liner defining at least part of an interior surface of the carrier; a cooling element (50), wherein the cooling element is arranged to be located behind the liner.

The cooling element may be a eutectic plate. Eutectic plates are well known, widely available and known to be effective. Alternative arrangements comprising other chilling technologies are possible but not, at this time, preferred.

The carrier may further comprise a lid arrangement. By adding a lid to the carrier, the thermal performance may be improved, leading to a longer period before the temperature in the carrier rises to an unacceptable level. However, a lid arrangement may not be required in all instances.

The lid arrangement may comprise a peripheral element arranged to fit closely into an upper opening of the carrier, and a hinged lid arranged to move between a closed and an open position. The hinged lid allows easy access to the content, especially when the carrier is used in a customer collection point, where access to the carrier is deliberately inhibited.

The peripheral element and the hinged lid may be arranged as a unitary element and the hinge is formed from an elongate weakened portion. By forming the lid arrangement as a unitary element, manufacturing and assembly costs may be reduced and reliability may be improved since there is no need to provide a separate hinge element.

The liner may comprise a primary liner arranged to be positioned adjacent to the plurality of thermally insulated walls and atop the thermally insulated base, whereby the cooling element is arranged, in use, to be positioned in a base of the carrier, atop the primary liner and with a secondary liner positioned above it.

The liner may be of unitary construction and arranged to be positioned adjacent to the plurality of thermally insulated walls and atop the cooling element which is arranged to sit directly atop the thermally insulated base.

The thermally insulated walls and base may be formed from phenolic board. Phenolic board is well known and widely available.

The liner may be moulded and be operable to at least partially hold the thermally insulated walls and/or base in position.

The carrier may comprise an external frame.

At least one of the plurality of thermally insulated walls may be secured to the external frame by means of a stud arranged to pass through an aperture in the external frame and penetrate the at least one thermally insulated wall.

The external frame may be integrally formed with the plurality of thermally insulated walls and/or base.

According to an another aspect of the present invention, there is provided a kit of parts for fitting to a suitable frame, comprising: a plurality of thermally insulated wall elements; a thermally insulated base element; a cooling element; and a liner, arranged to form an inner surface and to substantially conceal the plurality of wall elements, base element and cooling element, in normal use.

According to another aspect of the present invention, there is provided a customer collection facility comprising the carrier of any previous aspect.

According to the present invention there is provided an apparatus and method as set forth in the appended claims. Other features of the invention will be apparent from the dependent claims, and the description which follows.

BRIEF DESCRIPTION OF DRAWINGS

For a better understanding of the invention, and to show how embodiments of the same may be carried into effect, reference will now be made, by way of example, to the accompanying diagrammatic drawings in which.

The Figures have not been drawn to any particular scale, and are simply given as an aid to understanding the principles underlying and relating to the embodiments of the present invention.

DESCRIPTION OF EMBODIMENTS

Figure 1:
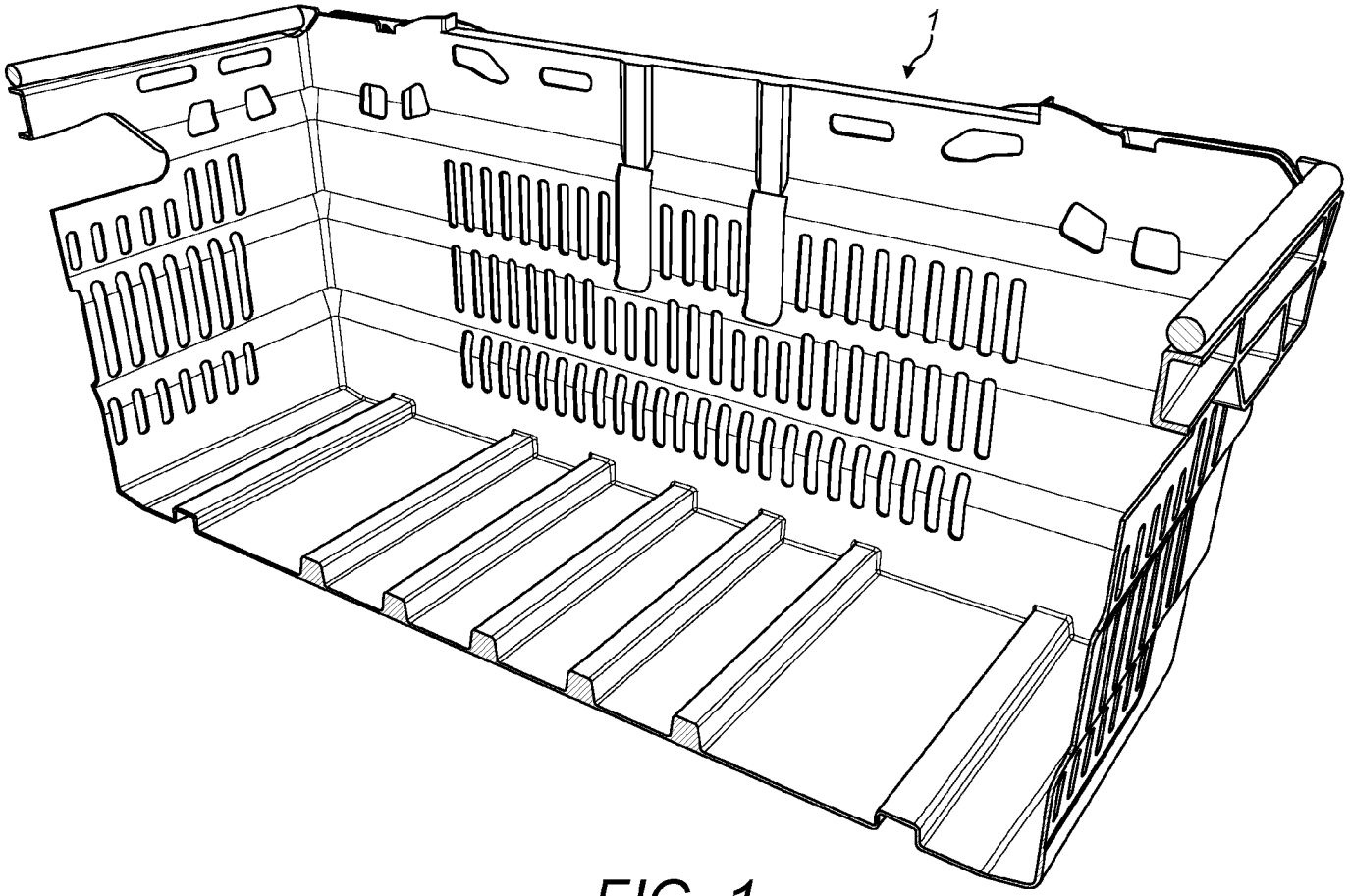
FIG. 1 shows a longitudinal sectional view of an external rigid or semi-rigid frame, which forms an external structure for an embodiment of the present invention.

FIG. 1 shows a longitudinal cross-section through an external frame 1 which forms part of an embodiment of the present invention. The external frame is in the form of a carrier, (also known as a crate or a tote), which may be used to accommodate and transport goods, for example from a retailer to a customer. Such a carrier may be used as part of a home shopping delivery system, whereby goods are picked from a central facility, packed into the carrier, loaded onto a suitable delivery vehicle and then delivered to the customer at their home or other address.

The carrier shown in FIG. 1 is formed to be rigid or at least semi rigid from a suitable plastics material.

According to an embodiment of the present invention, the carrier shown in FIG. 1 is adapted to provide thermal insulation such that it is suitable for transporting and/or storing frozen foodstuffs for a given period of time. In the form shown in FIG. 1 i.e. without any substantial insulation, frozen foodstuffs would soon defrost and become unviable.

Figure 2:
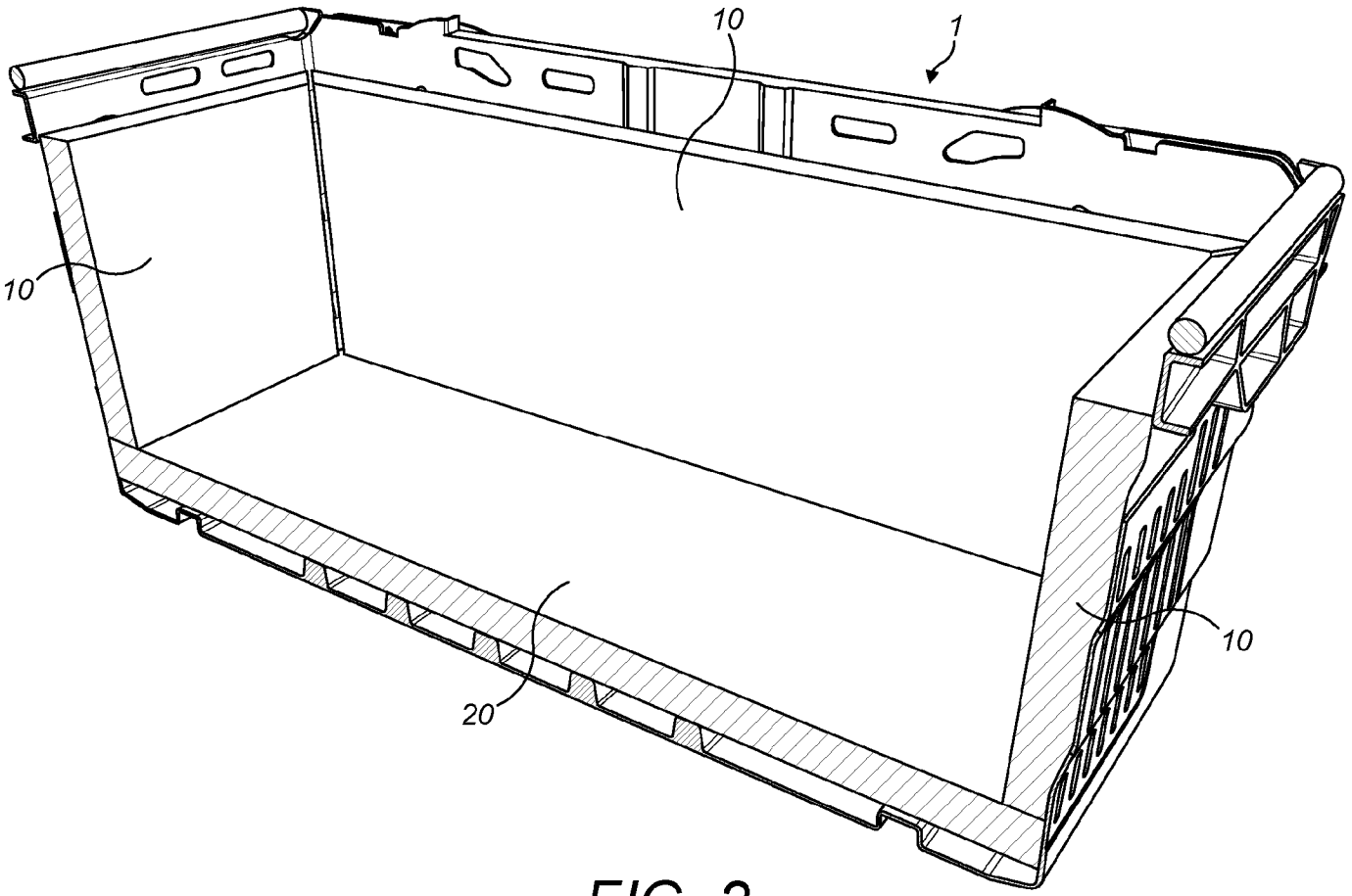
FIG. 2 shows a longitudinal sectional view of the frame of FIG. 1, provided with insulating wall members and base.

FIG. 2 shows a longitudinal cross-section, similar to FIG. 1, which reveals the insulating members which are added to the frame 1. The insulating members comprise four insulating walls 10 and an insulating base 20. The insulating base is arranged to sit in the bottom of the frame 1 and the insulating walls 10 are arranged to sit atop the insulating base and adjacent to the respective wall of the frame. The joining edges of each wall are bevelled to ensure a snug fit to ensure all-round thermal insulation.

In a particular embodiment, the thermally insulating walls 10 and base 20 may be integrally formed with the external frame 1 to yield a unitary device. This may be achieved by injection moulding or similar production techniques.

Alternatively, the insulating walls 10 and base 20 may be produced individually and fitted to an existing frame 1 and held in position by one or more fastening devices. This is a viable option since suitable frames 1 in the form of crates are available.

A suitable fastening device may take the form of a barbed stud which is arranged to pass through an aperture in the external frame 1 and thence penetrate the insulating material of the wall 10 or base 20. The barbed stud is provided with one or more projections from a central shaft thereof which are intended to allow a relatively easy insertion of the stud but to inhibit removal thereof.

The thermally insulating walls 10 and base 20 are formed from a suitable thermal insulator. A preferred material is phenolic board. This is lightweight and provides good thermal insulation properties. This is available widely under such brand names as Kingspan or Kooltherm. Other insulation materials may be used as required.

Figure 3:
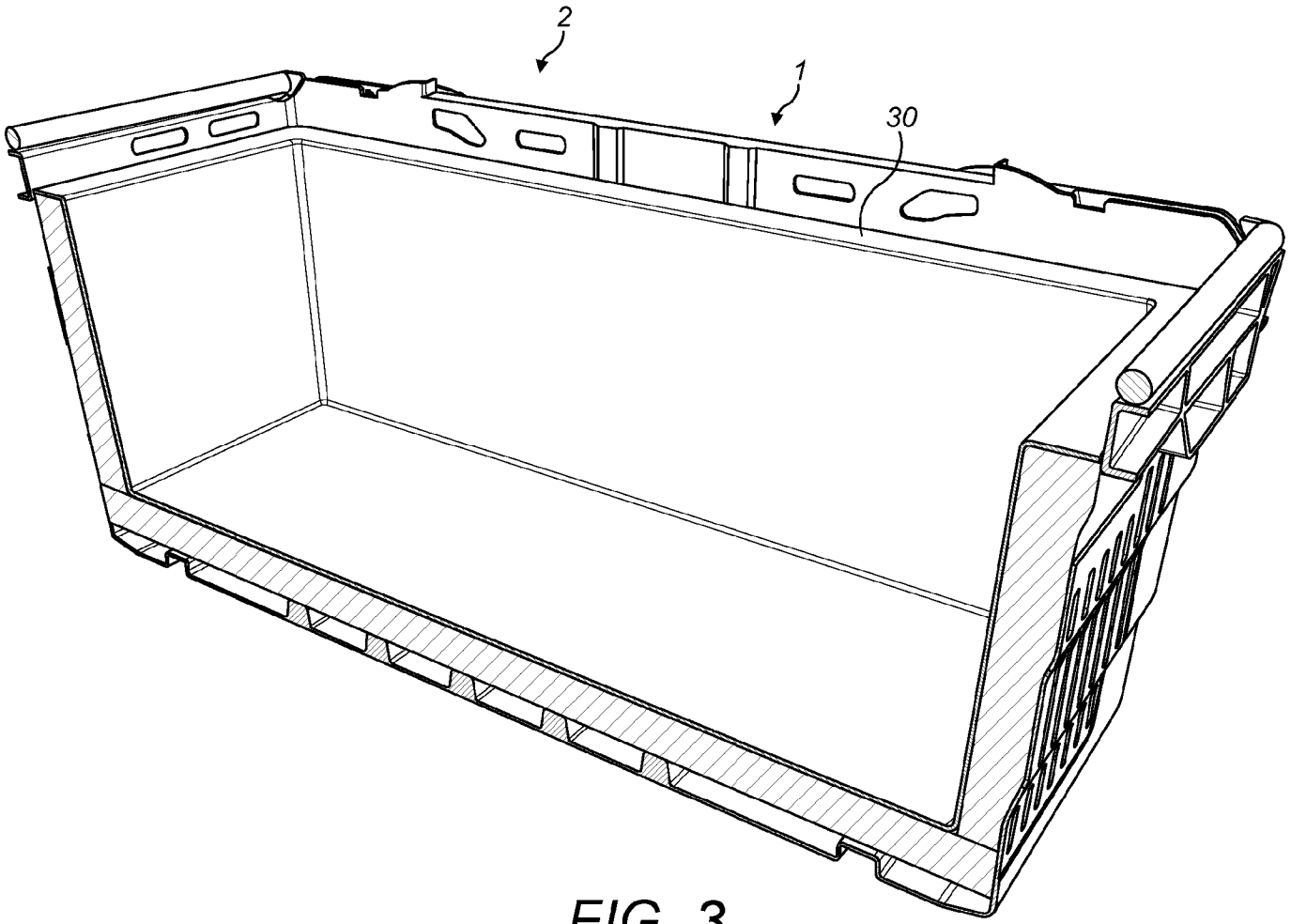
FIG. 3 shows a longitudinal sectional view of an embodiment of the present invention, which incorporates the device as shown in FIG. 2, with the addition of a liner.

FIG. 3 shows a carrier 2, according to an embodiment of the present invention, in longitudinal cross-section with the addition of a liner 30. The liner 30 is formed from a moulded plastics material and is shaped and arranged to define an inner surface of the carrier 2. The liner 30 is arranged to fit snugly adjacent to the walls 10 and base 20, assisting in keeping them in position and ensuring that the potentially delicate insulating material is protected in normal use.

By providing insulated walls 10 and base 20, a temperature of goods placed into the carrier 2 may be substantially maintained for a given period of time. However, for frozen foodstuffs, which may not be stored in an environment suitable for maintaining a suitable sub-zero temperature, further means are required to ensure suitable longevity for such frozen foodstuffs.

A separate cooling element is provided and this may be accommodated in one of at least two alternative locations. In order to describe these alternative locations, reference is invited to FIGS. 5 and 6.

Figure 5:
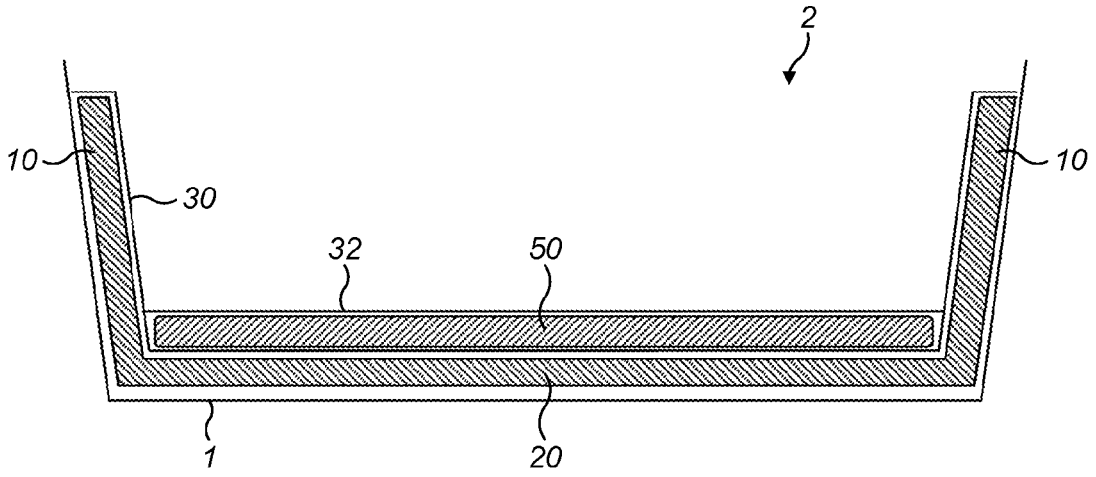
FIGS. 5 and 6 show alternative cross-sectional views illustrating alternative means of locating and obscuring a cooling element.

FIG. 5 shows a cross-sectional view through the carrier 2, previously described. It shows the thermally insulating walls 10 and thermally insulating base 20 as previously described. It also shows the location of the liner 30 which sits adjacent to the thermally insulating walls 20 and atop the thermally insulating base 30. Also shown positioned immediately atop the liner 30 is cooling element 50. Cooling element 50 is a eutectic plate and it is arranged to occupy substantially all of the base of the carrier 1.

Eutectic plates are well known in the art and their operation and construction will not be detailed herein.

The cooling element 50 is concealed in normal use by means of a secondary liner 32. The secondary liner 32 is arranged to sit atop the cooling element 50 and to shield it from the frozen foodstuffs placed into the carrier 1. The secondary liner 32 is shaped and arranged to provide a snug fit and to be hard to remove from the base of the carrier 1 in normal use. This may be achieved by sizing and shaping the secondary liner 32 such that no edges of it are accessible which would allow the secondary liner 32 to be levered out of position, thereby exposing the cooling element 50. Alternatively, a locking device may be provided to securely lock the secondary liner in position.

Figure 6:
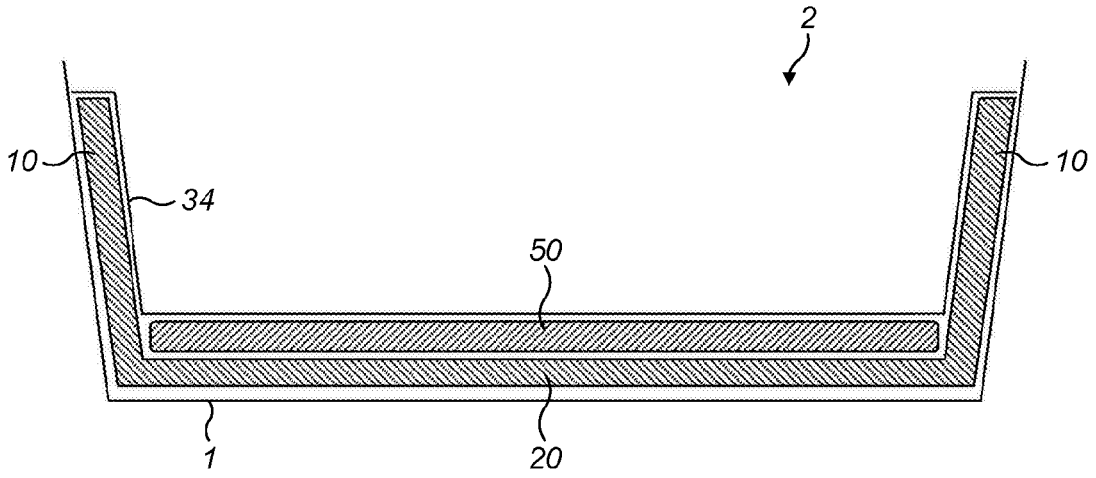

FIG. 6 shows an alternative embodiment whereby the cooling element 50 is located immediately atop the thermally insulating base 20 before the liner 34 is placed into position. This has the advantage that no secondary liner is required and the cooling element 50 is still concealed from view during normal use of the carrier 2.

The cooling element 50 is arranged to be removable from the carrier such that it may be refrozen to a suitable temperature as required. Typically, the cooling element 50 is frozen to a desired temperature, added to the carrier 1, concealed behind the liner 32 or liner 34 before the carrier 2 is filled with frozen foodstuffs as required.

The carrier 2 is then transported to its destination where the cooling element 50 acts to maintain a desired temperature for a defined period of time. Typically, such a period of time will be in the region of a few hours up to 1 day. When the carrier 2 is stored in an intermediate facility as described previously, such a period of time is sufficient for the customer to arrange collection of their order comprising the frozen foodstuffs in the carrier 2.

Once the customer has collected the order, the carrier 2 is recycled for future use, at which time the cooling element 50 is removed from the carrier 2 and refrozen for a defined period to be reused as required.

In this way, frozen foodstuffs may be maintained at a suitable temperature to ensure their viability and safety without requiring dedicated refrigerating equipment, operable at sub-zero temperatures, either during transport or subsequent storage at an intermediate facility.

Figure 4:
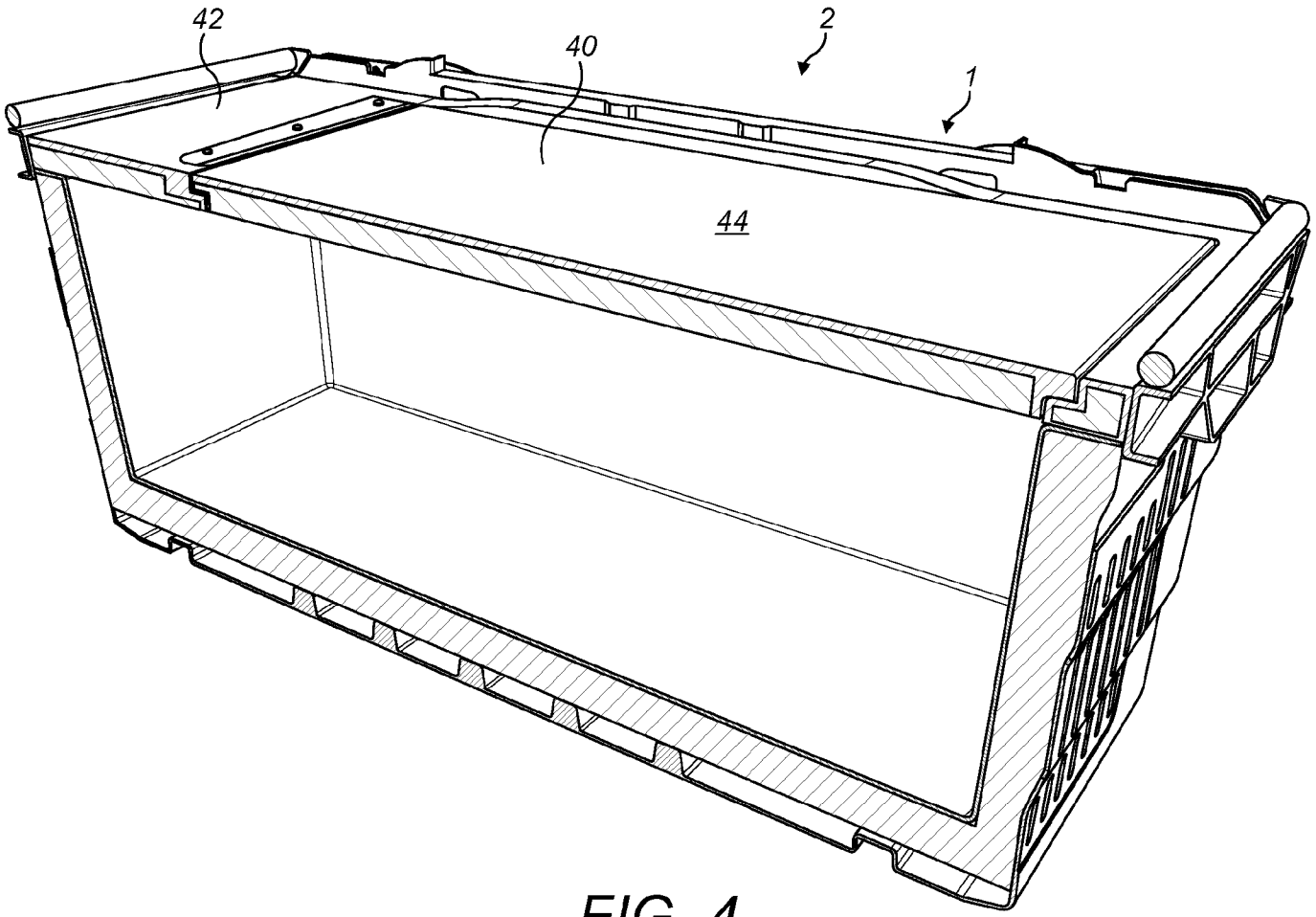
FIG. 4 shows a longitudinal sectional view of an embodiment of the present invention, with the addition of a lid arrangement.

Turning to FIG. 4, this shows a carrier 2 adapted to receive a lid arrangement 40. The lid arrangement 40 includes a peripheral member 42 and a lid 44. The peripheral member 42 is sized and shaped so as to sit atop the upper exposed surfaces of the liner 30 and to substantially close the opening at the top of the carrier 2. The lid arrangement may be fastened to the liner 30 or may simply rest atop it as required.

The lid 44 is hingedly attached to the peripheral member 42 so that it may be moved between a closed and an open position, thereby inhibiting or facilitating access, respectively, to the interior of the carrier 2 and so allowing insertion or removal of foodstuffs as required.

The lid arrangement is suitably formed from the same or similar materials as used for the thermally insulating walls 10 and base 20 and liner 30. All exposed portions of the lid arrangement are suitably clad in durable and hygienic material the same as or similar to liner material 30.

The lid 44 may be secured to the peripheral member 42 by means of a separate hinge device which may be fastened into position using suitable fasteners or adhesives. Alternatively, the portion of the peripheral frame 42 proximal the hinged part of lid 44 may be clad in a contiguous length of liner material provided with an elongate weakened portion defining the hinge axis. In this way, the lid 44 is attached to the peripheral frame 42 without requiring any further parts or materials. By careful selection of the material used to clad the lid arrangement 44 and dimensions of the elongate weakened portion, a long-lasting and reliable hinge arrangement can be provided.

The use of a lid arrangement 40 is optional and may not be required in all instances.

By making use of a carrier 2 as previously described, it is possible to distribute and store frozen foodstuffs for a period of time in excess of that possible using previously known carriers. Furthermore, the carrier 2, herein described, is compatible with transport systems used currently, since the external frame 1 is substantially the same as the crates used to transport customer orders currently.

One intended use of carriers 2 according to an embodiment of the present invention is with the previously mentioned intermediate facility whereby customers may collect orders which have been previously delivered to the intermediate facility and stored for later automatic dispensing to the customer.

In such a facility, an automated robotic system retrieves carriers 2 which have been previously stored and delivers them to a customer collection point from which the customer retrieves the products from the one or more carriers presented to him. The details of the automated system are not important for the purposes of understanding embodiments of the present invention. However, FIG. 7 and FIG. 8 are provided to provide further details of the carrier 2.

Figure 7:
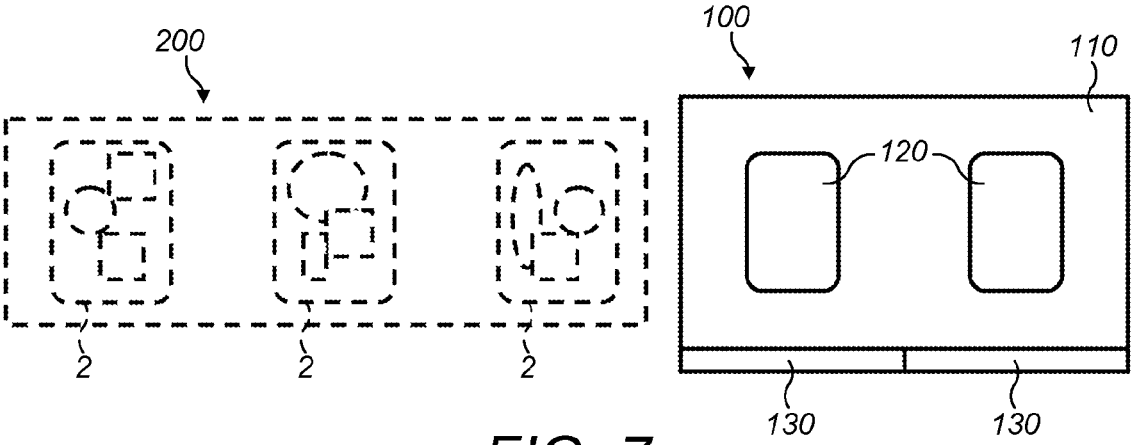
FIGS. 7 and 8 show plan views of a customer collection point suitable for use with embodiments of the present invention.
Figure 8:
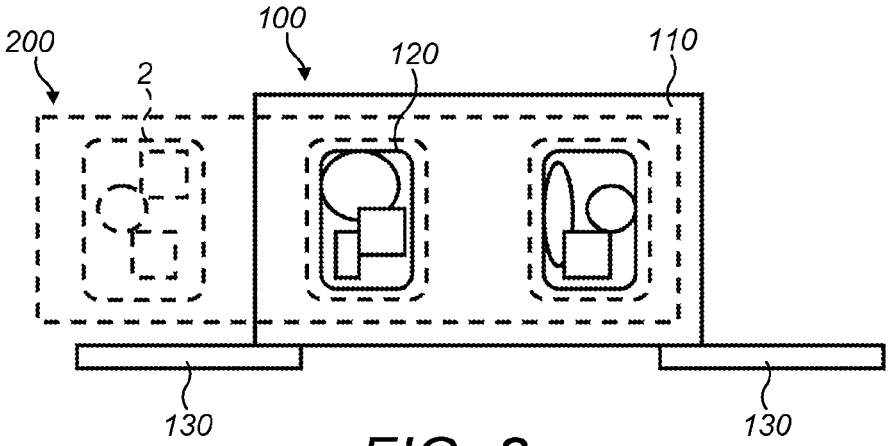

FIG. 7 shows a plan view of a customer collection point 100. The customer collection point 100 comprises a counter 110 normally concealed behind a pair of sliding doors 130. Upon arrival at the customer collection point 100, which forms part of the intermediate facility referred to previously, the customer identifies himself using a suitable form of identification such as a smartcard or printed barcode. The automated system then acts to retrieve details of the customer's order and retrieves the carriers 2 which have been pre-filled and stored with the ordered products, inside the facility.

The automated system positions the carriers 2 on a transport arrangement 200 which is arranged to receive the carriers and to then to move to position itself beneath the counter 110.

Access to the contents of the carriers 1 is provided by means of a plurality of apertures 120, located in the counter 110. The apertures 120 are dimensioned such that they are smaller in at least one dimension than the corresponding dimension of the carriers 2. This can be seen clearly in FIG. 8 with the aperture 120 is seen to reside fully within the outline of the carrier 2.

By means of such an arrangement, it is not possible for the customer to remove the carrier 2 but only to gain access to the products located inside the carrier 1. Such a system allows easy access to the products without providing an opportunity for the customer to remove the carrier 2 from the system. Such removal would damage the integrity of the system and/or could result in the build-up of discarded carriers in the vicinity of the collection point.

In the case of a carrier conforming to an embodiment of the present invention, the cost of replacing such a carrier could be high and it is important for the system operator to therefore retain ownership and control of these carriers, in particular.

The term "carrier" has been used throughout the above embodiments. Again, "carrier" is functional in nature, and could refer to one of a number of different structures, or the same structure having different names, for example in different countries. For instance, a carrier might be alternatively and/or additionally described as, and/or functionally defined as, a tote, a crate, a box, a basket, and the like. Typically, the carrier will be rigid in form, and be self-supporting in form (e.g. as opposed to a plastic bag or similar). That is, the carrier is rigid enough to be handled in the automated manner described above, whilst carrying and retaining products, but without being so readily deformable as to be extractable through (e.g.) the apertures 120 without damaging the carrier. The carrier might typically take the form of an open crate-like or basket-like structure, which might be formed at least partially from a polymeric material.

Typically, all carriers used in the system will have substantially the same external shape, size and, likely, surface detailing. This consistency will assist in the automated handling and general processing of the carriers as described above in an automated manner. To that extent, even prepackaged products, which might be packaged in shipping and/or postal packaging, might still be transported around the system in such carriers, since it is likely to be much easier to handle uniform carriers as previously described, than different shaped individually packaged products in isolation.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A shopping carrier for carrying products, the shopping carrier comprising: a plurality of thermally insulated walls; a thermally insulated base defining at least part of an interior surface of the shopping carrier, the thermally insulated walls and base abutting a frame of the shopping carrier and configured for removal together from the frame; a liner along only a surface of the base from one side of the base and directly adjacent a first thermally insulated wall to another side of the base and directly adjacent a second thermally insulated wall; and a eutectic plate for cooling an interior of the shopping carrier, wherein the eutectic plate is arranged to be concealed behind the liner and between a surface of the thermally insulated base and the liner, wherein the liner is arranged to extend directly over and directly abut a top surface of the eutectic plate so that the eutectic plate is positioned between the liner and the thermally insulated base and immediately atop the base to directly abut the base, wherein the eutectic plate is removable for refreezing and reinserting the eutectic plate between the liner and the base, wherein the liner is formed from a plastics material, and wherein each thermally insulated wall has a topmost surface that is directly exposed to an opening to the interior surface and absent the liner.

2. The shopping carrier of claim 1 further comprising a lid arrangement over the interior surface of the shopping carrier, and including a hinge arrangement over the interior surface to delineate a first region of the interior surface from a second region of the interior surface and that permits a lid of the lid arrangement to pivot above one of the first and second regions of the interior surface relative to the other of the first and second regions.

3. The shopping carrier of claim 2 wherein the lid arrangement comprises:

a peripheral member arranged to fit closely into an upper opening of the shopping carrier; and the lid constructed and arranged to move between a closed and an open position.

4. The shopping carrier of claim 3 wherein the peripheral member and the lid are arranged as a unitary element and wherein the hinge arrangement includes an elongated weakened portion for forming a hinge.

5. The shopping carrier of claim 1 wherein the liner comprises a primary liner that includes side portions arranged to be positioned adjacent to the plurality of thermally insulated walls and a bottom portion extends from the side portions to further extend over the thermally insulated base.

6. The shopping carrier of claim 1 wherein the liner is of unitary construction and is arranged to be positioned adjacent to the plurality of thermally insulated walls and atop the eutectic plate which is arranged to sit directly atop the thermally insulated base.

7. The shopping carrier of claim 1 wherein the thermally insulated walls and the thermally insulated base are formed from a phenolic board.

8. The shopping carrier of claim 1 wherein the liner is moulded and is operable to at least partially hold the thermally insulated walls and/or the thermally insulated base in position.

9. The shopping carrier of claim 1, wherein the frame comprises an external frame.

10. The shopping carrier of claim 9 wherein the external frame is integrally formed with the plurality of thermally insulated walls and/or the thermally insulated base.

11. A kit of parts for fitting to a frame for a shopping carrier, comprising:

a plurality of thermally insulated wall elements;

a thermally insulated base element, the thermally insulated wall elements and base element abutting the frame of the shopping carrier and configured for removal together from the frame;

a liner along only a surface of the base element from one side of the base element and directly adjacent a first thermally insulated wall element to another side of the base element and directly adjacent a second thermally insulated wall element;

a eutectic plate for cooling an interior of the kit of parts, and, wherein the eutectic plate is arranged to be concealed behind the liner and between a surface of the thermally insulated base element and the liner, wherein the liner is arranged to extend directly over and directly abut a top surface of the eutectic plate so that the eutectic plate is positioned between the liner and the thermally insulated base and immediately atop the base to directly abut the base element, wherein the eutectic plate is removable for refreezing and reinserting the eutectic plate between the liner and the base, and wherein at least a side portion of the liner is formed from a plastics material, and wherein each thermally insulated wall element has a topmost surface that is directly exposed to an opening to the interior and absent the liner.

12. A customer collection facility comprising a shopping carrier, comprising:

a plurality of thermally insulated walls;

a thermally insulated base defining at least part of an interior surface of the shopping carrier, the thermally insulated walls and base abutting a frame of the shopping carrier and configured for removal together from the frame;

a liner along only a surface of the base from one side of the base and directly adjacent a first thermally insulated wall to another side of the base and directly adjacent a second thermally insulated wall;

a eutectic plate for cooling an interior of the shopping carrier, wherein the eutectic plate is arranged to be concealed behind the liner and between a surface of the thermally insulated base and the liner, wherein the liner is arranged to extend directly over and directly abut a top surface of the eutectic plate so that the eutectic plate is positioned between the liner and the thermally insulated base and immediately atop the base to directly abut the base, wherein the eutectic plate is removable or refreezing and reinserting cold source between the liner and the base, and wherein at least a side portions of the liner is formed from a plastics material, and wherein each thermally insulated wall has a topmost surface that is directly exposed to an opening to the interior surface and absent the liner.

* * * * *